United States Patent [19]

Willemsens et al.

[11] Patent Number: 4,877,639

[45] Date of Patent: Oct. 31, 1989

[54] COATING METHOD

[75] Inventors: Karel S. Willemsens, Berchem; Willy N. V. Abbeneyen, Merksem; Frans B. Criel, 's-Gravenwezel, all of Belgium

[73] Assignee: Agfa-Gevaert N.V., Mortsel, Belgium

[21] Appl. No.: 213,112

[22] Filed: Jun. 29, 1988

[30] Foreign Application Priority Data

Jul. 21, 1987 [EP] European Pat. Off. ..... 87201378.4

[51] Int. Cl.[4] ..... B05D 1/26; B05D 1/30; B05D 1/34

[52] U.S. Cl. ..... 427/13; 427/412.2; 427/420; 118/411

[58] Field of Search ..... 427/13, 412.2, 420; 118/411

[56] References Cited

U.S. PATENT DOCUMENTS

| | | | |
|---|---|---|---|
| 3,220,877 | 11/1965 | Johnson | 427/420 |
| 3,531,314 | 9/1970 | Kerr et al. | 427/27 |
| 4,525,392 | 6/1985 | Ishizaki et al. | 427/420 |

*Primary Examiner*—Shrive Beck

*Attorney, Agent, or Firm*—William J. Daniel

[57] ABSTRACT

A method of starting the bead coating of a moving web with a composite liquid layer comprising a higher viscous and lower viscous layer of coating compositon, by reducing the rate of flow of the higher viscous layer to zero, reducing the pre-starting distance between the coater and the web to at most the normal coating gap and initiating the wetting of the web by the lower viscous layer, and then adjusting the rate of flow of the higher viscous layer to the normal coating value.

11 Claims, 5 Drawing Sheets

COATING METHOD

DESCRIPTION

Figure 1:
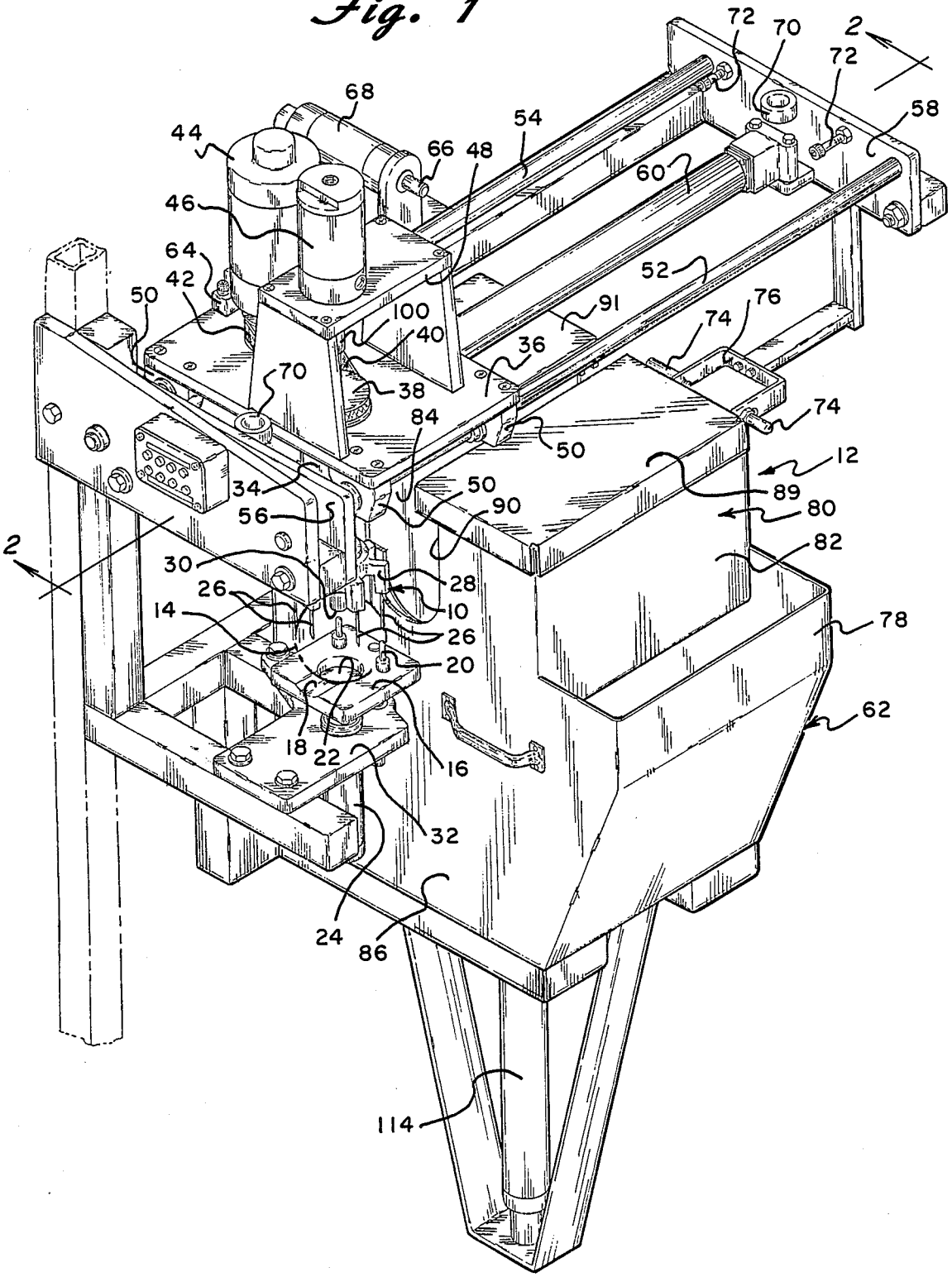

The present invention relates to a method of coating a moving web with a composite liquid layer consisting of at least two distinct, superimposed liquid layers, and in particular to a method for starting such coating.

In U.S. Pat. No. 2,681,294 a method of coating a moving web is disclosed which includes flowing a ribbon of a liquid composition in a stream between a coating device and a surface to be coated while maintaining a greater gaseous pressure on that side of the ribbon from which the coated material moves away than on that side towards which the material to be coated approaches.

The method has proved to be very successful in the photographic industry for the simultaneous coating of two or more layers by means of a so-called slide hopper coater, the different layers bridging the free distance between the coater and the web in the form of a bead or pile of liquid from which liquid is continuously withdrawn as the web advances.

This method presents certain difficulties in starting a coating which result in a considerable loss of coated material. As the method is practiced, the coating device in which the coating composition is contained is usually positioned several centimeters from the web to start the free flow of coating composition. The coating device is then moved towards the web and at the same time suction is applied. The coating device is moved almost into contact with the web and held in this position until the coating bead is formed. Once the bead has been properly formed, the device is moved away from the web to a normal coating position. Common coating distances are between 0.2 and 0.4 mm. Observation of the coated material at the start of coating made in this way indicates that there is an excessive laydown of the composition of material at the instant of wetting and such excess of liquid composition can extend for several meters longitudinally of the material. This thicker layer does not dry as quickly as a layer of normal thickness and subsequently tracks off onto the rollers for supporting the material as it is moved through a drying station. The portion of the material coated with the thicker layer as well as those portions of the material which have picked up streaks of the coating composition from the web conveying rollers cannot be used, and hence must be cut out of the roll and scrapped.

It has been proposed to overcome the disadvantages of the described method by utilizing a surge of higher than normal suction as the coating device approaches the moving web. This higher suction is maintained until the ribbon of coating composition forms the necessary bead with the web, and is then reduced to the normal suction as the coating device is moved to its coating position. As the lip of the coating device approaches the moving web, a high velocity throat is formed with the strip material and a corresponding higher velocity of air flow through the throat results therefrom which pulls the large melt of coating composition that has accumulated down over the lip and carries it away in the air stream. The described starting method is disclosed in U.S. Pat. No. 3,220,877.

Practice has shown that this method is very critical to operate and that for each particular coating composition, i.e. for each particular coating viscosity and each particular wet coating thickness, a corresponding magnitude of the surge must be used in order to obtain a satisfactory operation. Furthermore, the application of the method necessitates a second vacuum source to be used for the vacuum chamber for stabilizing the coating bead, since the acceleration and the subsequent deceleration of the basic blower for establishing the required underpressure in the vacuum chamber, proceed much too slowly.

It is the object of the present invention to provide an improved starting technique, for bead coating, in the coating of at least two layers simultaneously.

According to the present invention, a method of coating a moving web with a composite liquid layer consisting of at least two distinct superimposed liquid layers with different viscosities, by moving the web adjacent and relative to a coating device, producing in the coating device distinct liquid layers and superimposing said liquid layers onto each other to form one composite layer, discharging the composite layer from the coating device onto said web to form and maintain a bead of liquid composition between a lip of the coating device and the moving web, and subjecting the bead of liquid coating composition to a differential air pressure to withhold the bead for movement in the direction of travel of the web, the air pressures being selected to retain the beam of coating composition in a coating position between the coating device and the web and to maintain a uniform coating on the web, the higher air pressure being on the side of the bead remote of the web, in which method the coating is pre-started by establishing a distance between the coater and the web which is greater than the normal coating gap and forming a flowing stream of said distinct liquid layers, characterised in that the coating is started by reducing the rate of flow of the higher viscous layer, or of at least one of them in case there is more than one such layer, to zero, it being understood that the rate of flow of the higher viscous layer(s) that is (are) located between the web and the lower viscous layer, or the first lower viscous layer in case there is more than one such layer, is reduced to zero, reducing the distance between the coater and the web to at most the normal coating gap and initiating the wetting of the web by the lower viscous layer, or by one of the lower viscous layers in case there is more than one such layer, and then adjusting the rate of flow of the liquid layer(s) to the normal coating value.

In the case of conventional slide hopper coating wherein the web performs an upward movement past the lip of the coater, the relative location of the different layers in the composite layer on the slide hopper coater corresponds with the location of the layers on the web. However, it is also possible to receive the composite layer on a web which moves downwardly past the coater, and in such case the order of the layers becomes reversed, the upper layer on the web being in fact the lower one on the coater.

The expression "pre-starting" indicates the operations known in the art that are carried out preparatory to the actual starting. The speed of the web, or of its leader, may be zero during such pre-starting operations, but the web may also run at a temporarily reduced speed. The flow rates of the different coating compositions during the pre-starting phase may be equal to the normal flow rates, but they may occasionally also differ therefrom.

The expression "starting" points to the manipulations that are carried out after the pre-starting, while the web is running, and it is clear that their performance should proceed as quickly as possible in order to limit waste of valuable web and/or coating material.

In the application of the method according to the invention it appears that the first wetting of the web by the coating composition occurs according to a non-uniform pattern, considered transversely of the web. This pattern may consist of a plurality of transversely spaced streaklike coated zones, separated by uncoated zones, but it may also consist of one or some zones where wetting by the coating composition starts on a limited area, and then slowly increases in width as the web travel goes on, until a uniform coating according to the width of the web has been obtained.

The last step of the method according to the invention, namely the re-adjustment of the rate of flow of the liquid layer(s) to the normal coating value, has the surprising effect that the initial non-uniform coating pattern on the web that is formed by the lower viscous layer(s) is rapidly transformed into a perfectly uniform coating pattern. This change-over occurs within 1 to 3 seconds, whereas the time required for the complete starting operation may be less than 10 seconds.

The method according to the invention can be easily performed by appropriate adjustment of valves in the liquid supply conduits to the corresponding sections of the coating device. The method does not require any constructional modification of an existing coating device.

The initiation of the wetting of the web by the lower viscous coating composition(s) usually does not proceed spontaneously. The wetting may be established by means of a small strip of film, fabric or the like that is pulled by the operator through the coating gap from one lateral end to the other. However, the success of a suchlike operation is entirely dependent on the skill of the operator, and therefore a by far more reliable wetting aid is formed by an electrostatic charge that is applied onto the web for electrostatically pulling the low-viscous liquid layer in good wetting contact with the web surface.

According to a preferred embodiment of the invention, the rate of flow of the lower viscous coating composition(s) is adjusted such that (a) lower viscous layer(s) with a thickness of at least 20 micrometer is obtained.

The value of 20 micrometer should be considered as an average value for the layer thickness, or in other words as the quotient of the rate of flow of the coating composition(s) forming this (these) layer(s), divided by the web speed and the coating width. If said layer(s) were uniform during the starting of the coating, the minimum thickness were 20 micrometer, but the description hereinafter will make it clear that such layer(s) is (are) not uniform at all during the starting phase and in consequence the actual layer thickness may vary locally from zero upto a multiple of 20 micrometer.

The obtaining of a wet layer thickness of at least 20 micrometer of the lower viscous layer, in the case of a two-layer coating, will mostly require an increasing of the normal rate of flow of said layer. Usual increases of the flow rate will be 50% or more.

Such 20 micrometer wet layer thickness in the case of more than one lower viscous layer, may be obtained by the combined thickness of two or more lower viscous layers.

The difference in viscosity of the at least two liquid layers in the method according to the invention may be small or great, but in a suitable embodiment of the method the ratio between said viscosities is at least 1:1:50. Further, the viscosity of the higher viscous layer will generally be higher than 10 mPa.s.

During the starting operation, the distance between the coater and the web, called hereinafter the coating gap may be temporarily reduced to a distance that is smaller than the normal value, and said reduced distance may be re-adjusted to the normal value after the rates of flow of the distinct liquid layers have been adjusted to their normal values. This feature may accelerate the establishing of a uniform coating pattern as the rate of flow of the high-viscous layer(s) is adjusted to the normal value.

The method according to the invention can advantageously be used for bead-coating a plurality of layers according to the method of U.S. Pat. No. 4,001,024. In this patent specification, there is disclosed a method of bead coating a plurality of layers of liquid coating compositions, wherein the lowermost layer is thin and formed of a coating composition of low viscosity, and the next layer is thicker and has a higher viscosity. This method shows the advantage that the lowermost layer offers a good wettability of the support whereby high coating speeds are allowed, and yet that the water content of the two layers together may remain small whereby the drying of the layers may proceed rapidly. According to a particular embodiment of this method, the lowermost layer is formed from a gelatin/silver halide composition that is used to form the layer next above it, except that such composition would be diluted to the appropriate low viscosity in order to be used to form the lowermost layer.

Figure 2:
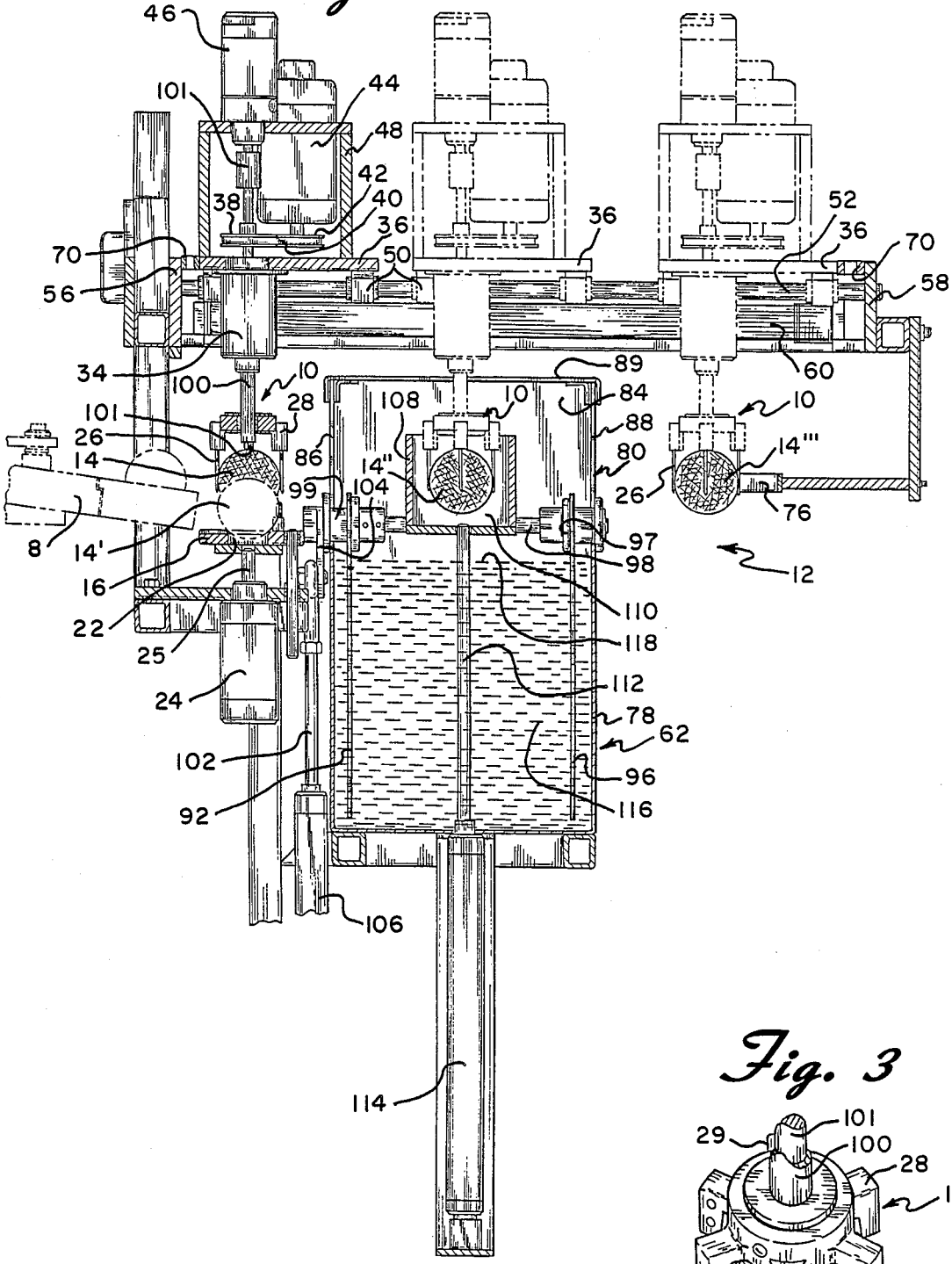
Figure 3:
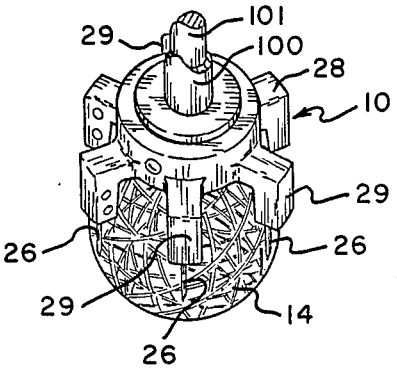
Figure 4:
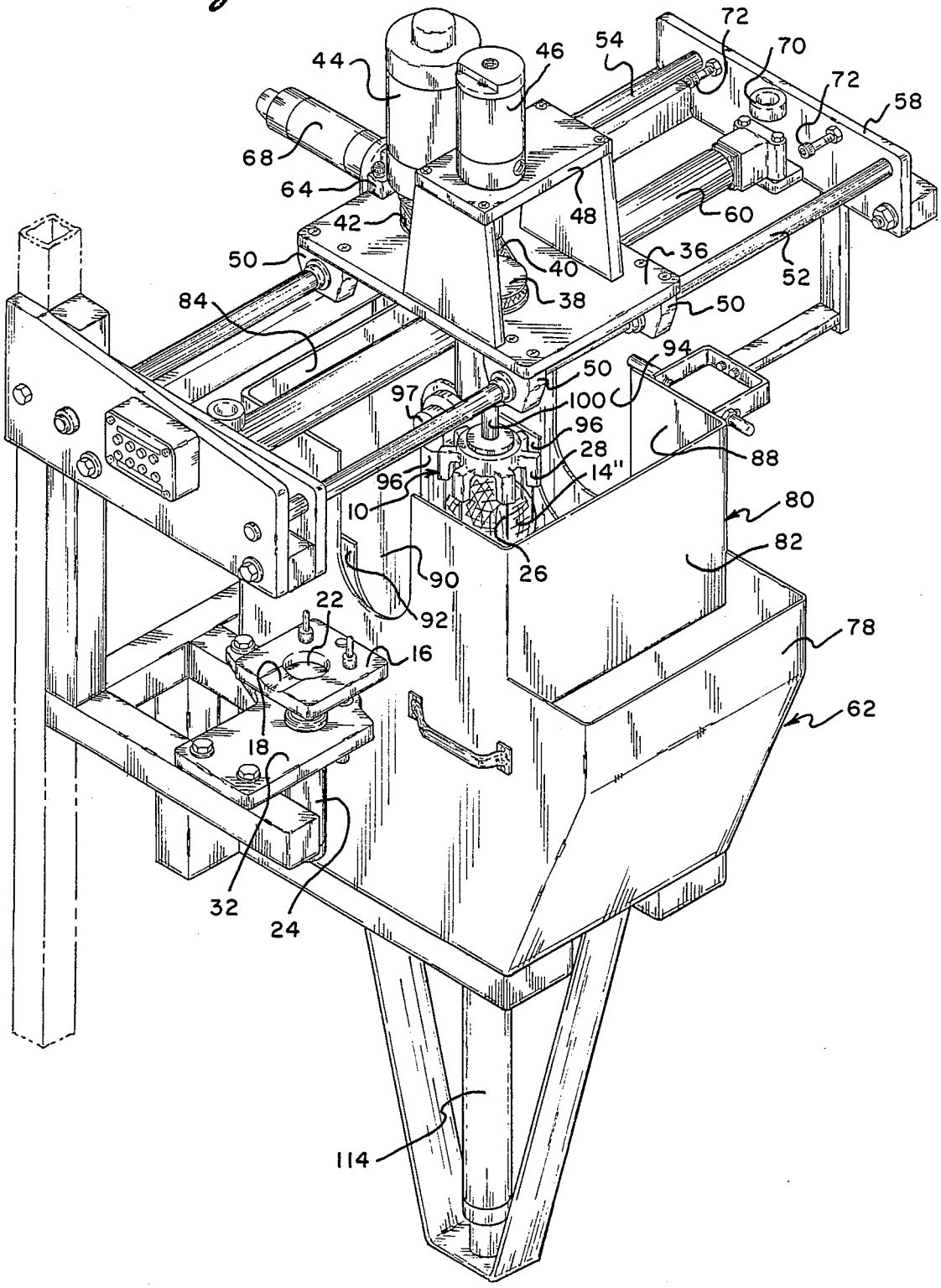
Figure 5:
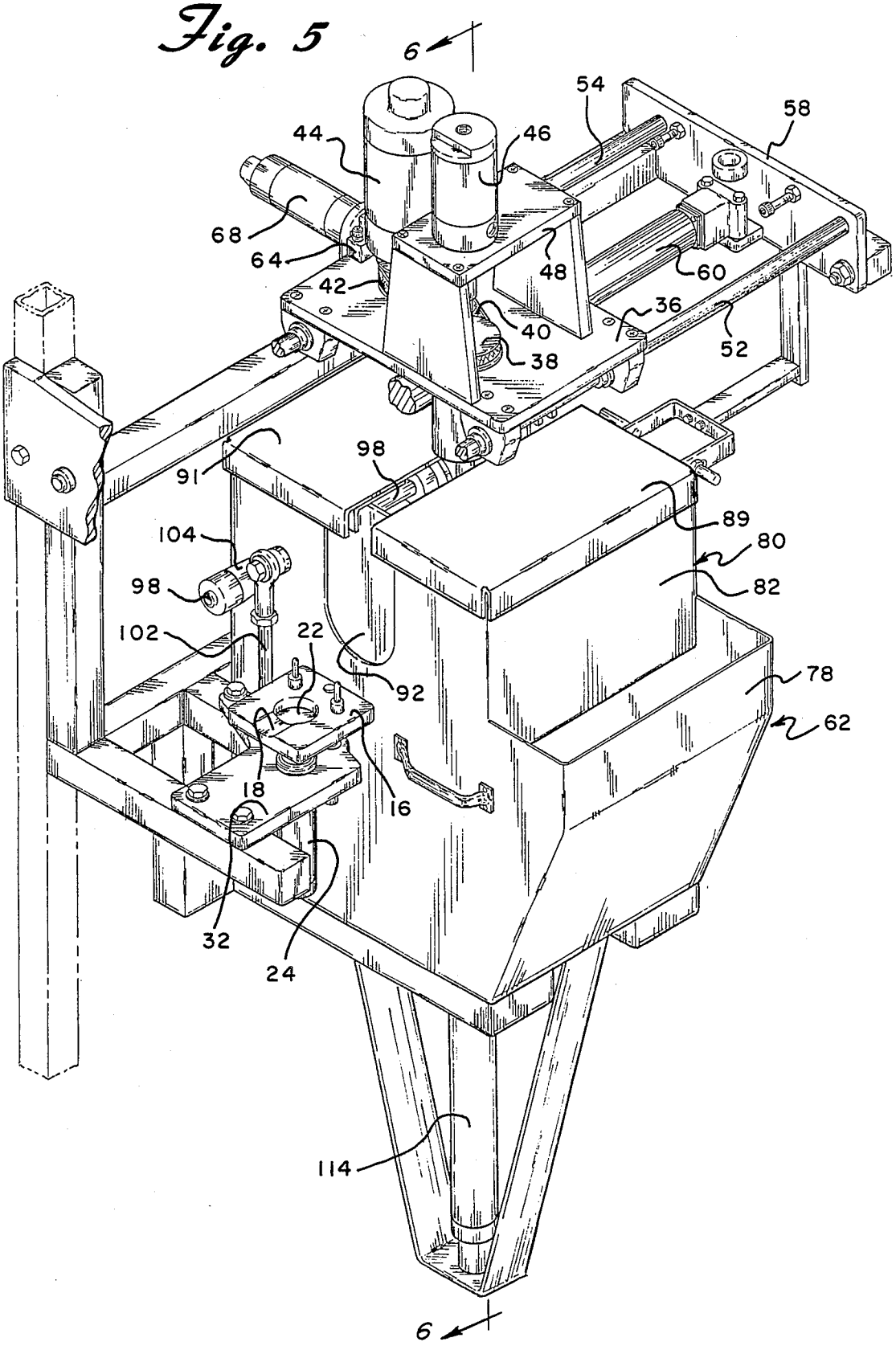
Figure 6:
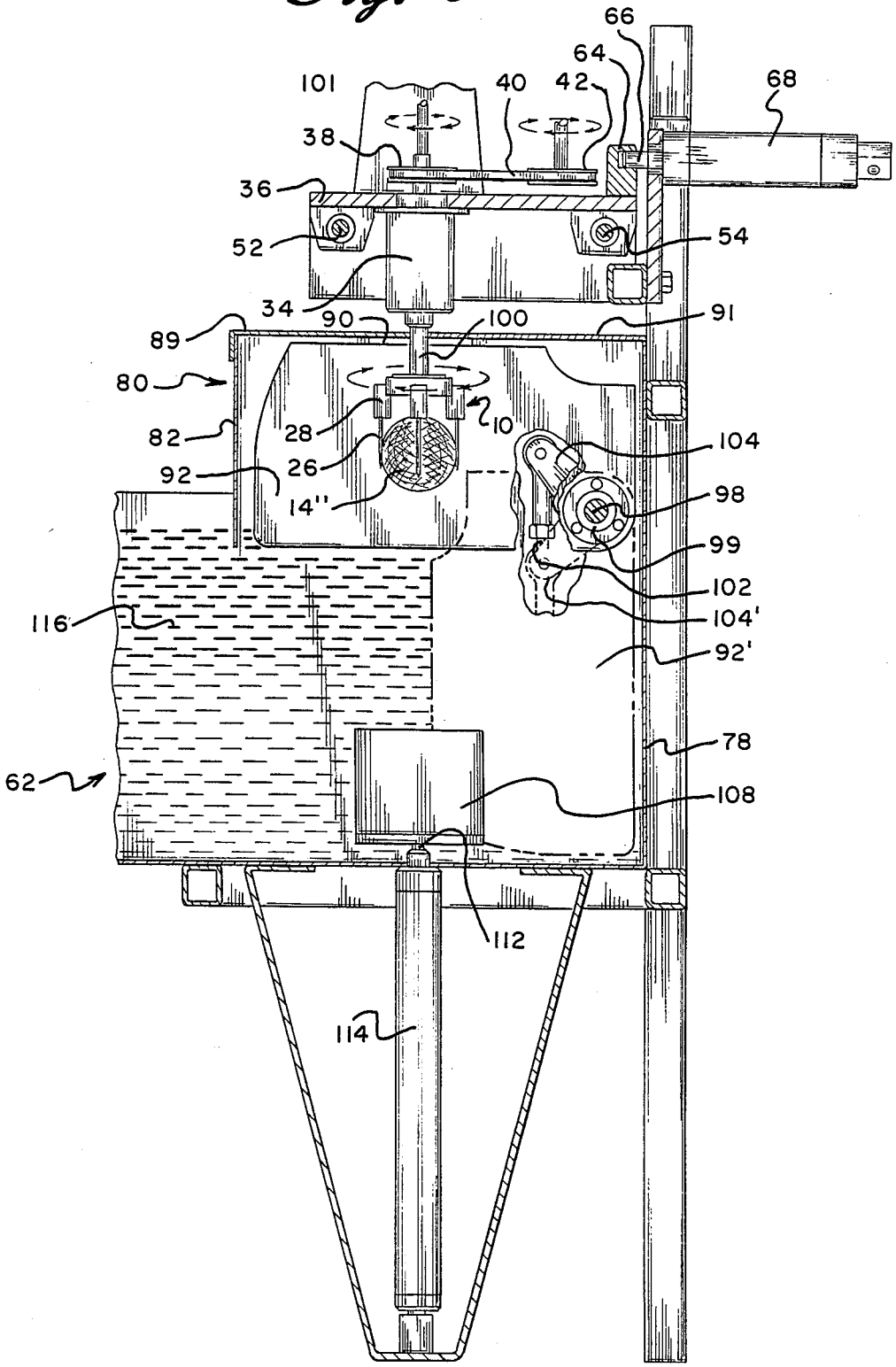
Figure 7:
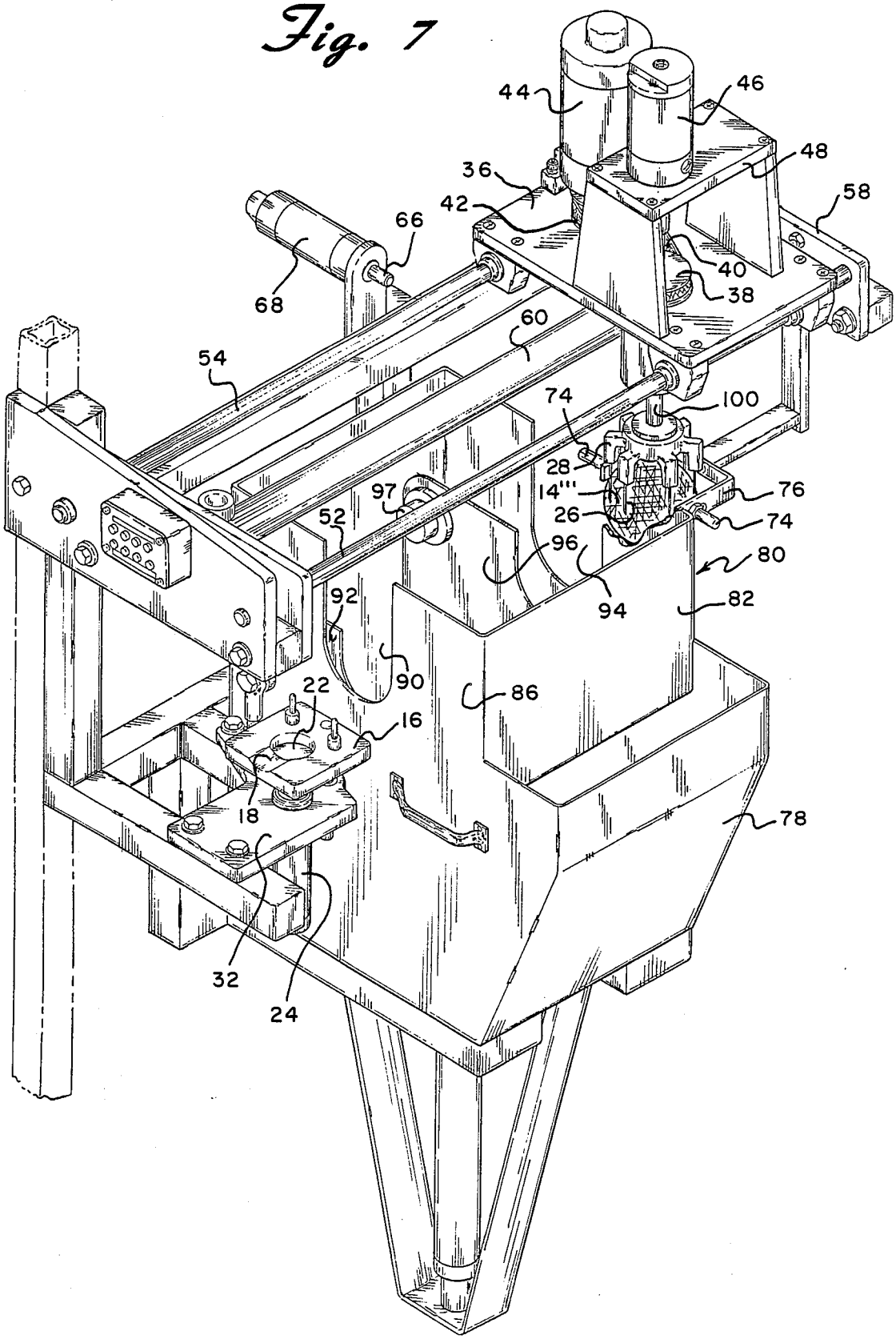
Figure 1:
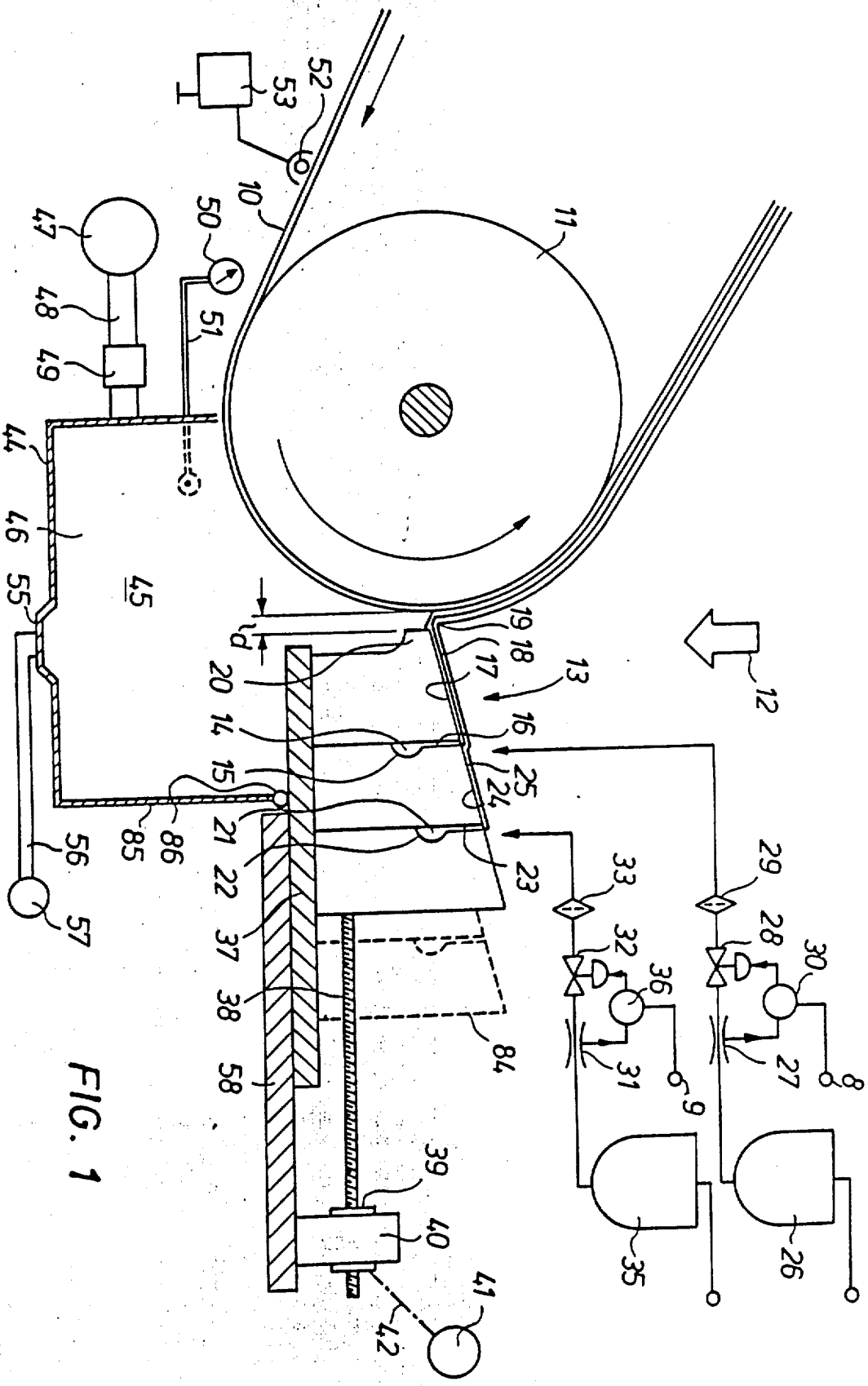
Figure 2:
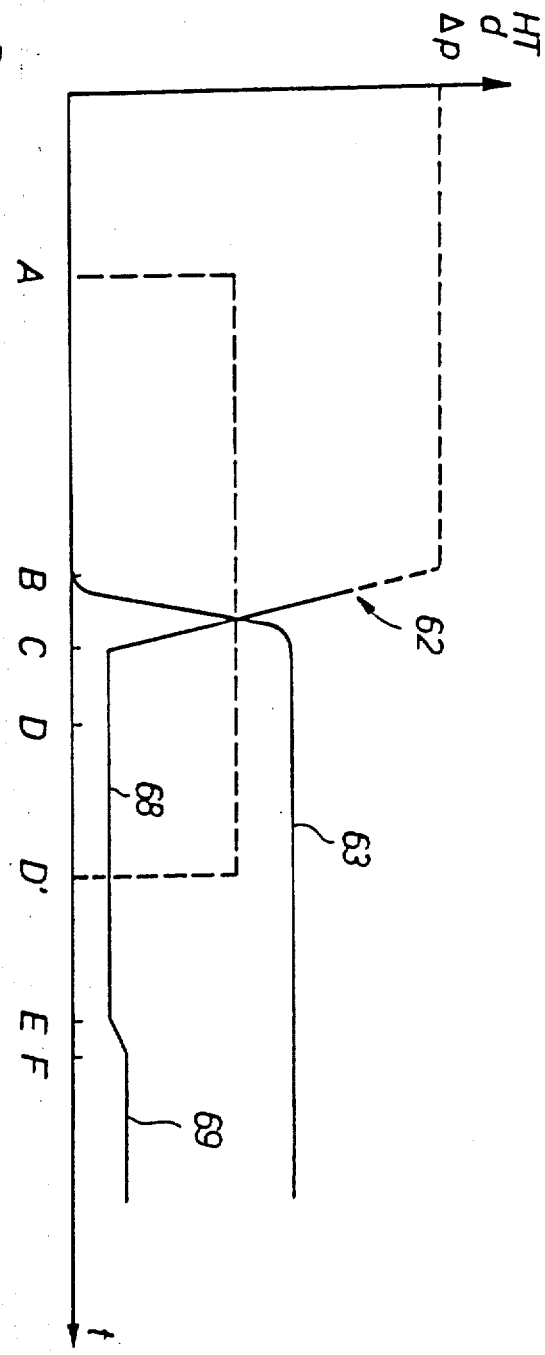
Figure 3:
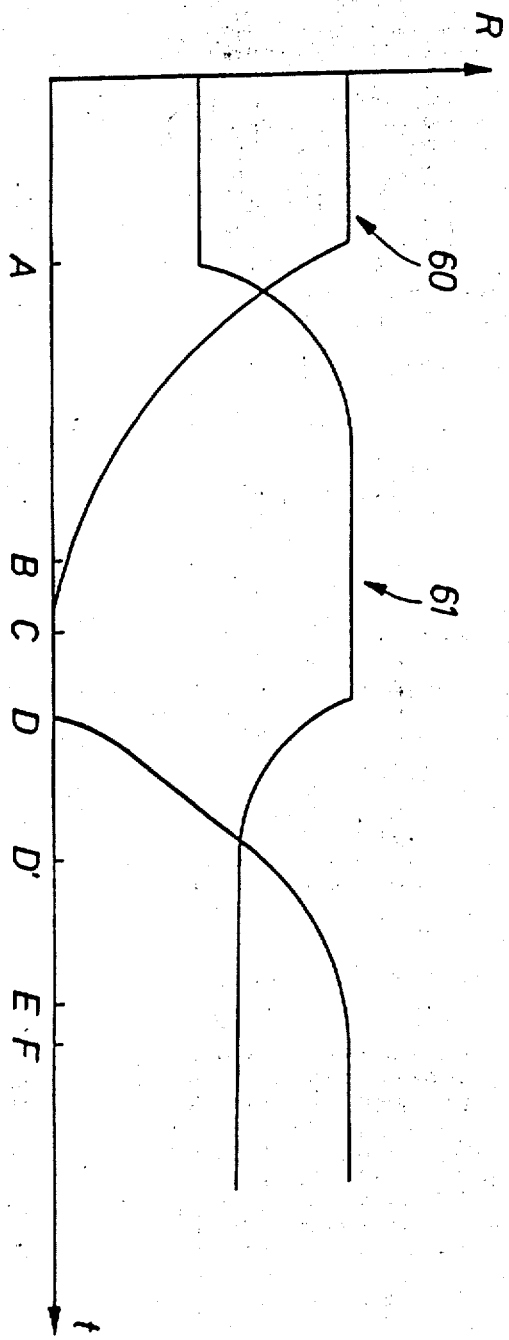
Figure 4:
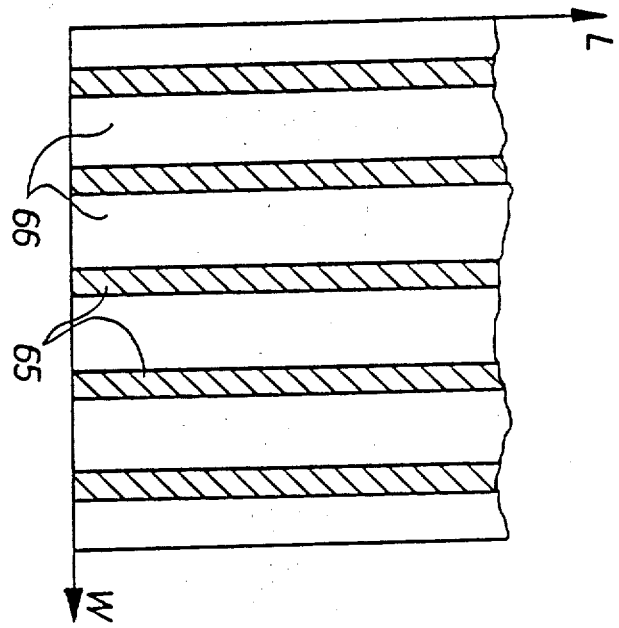
Figure 5:
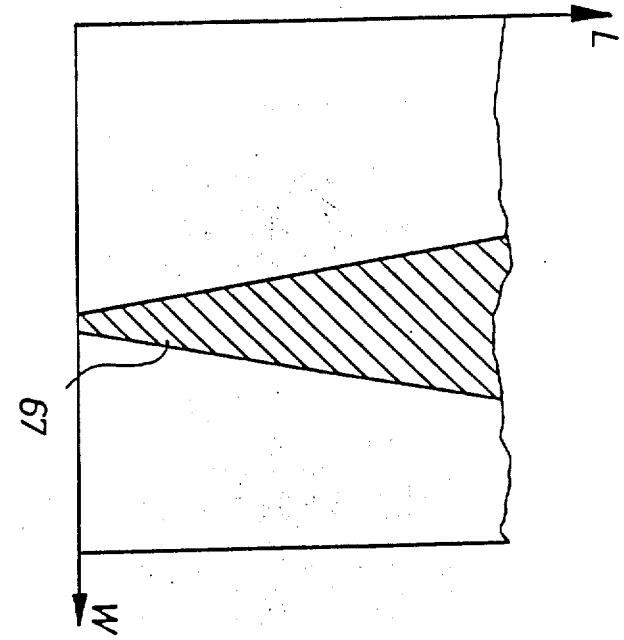
Figure 6:
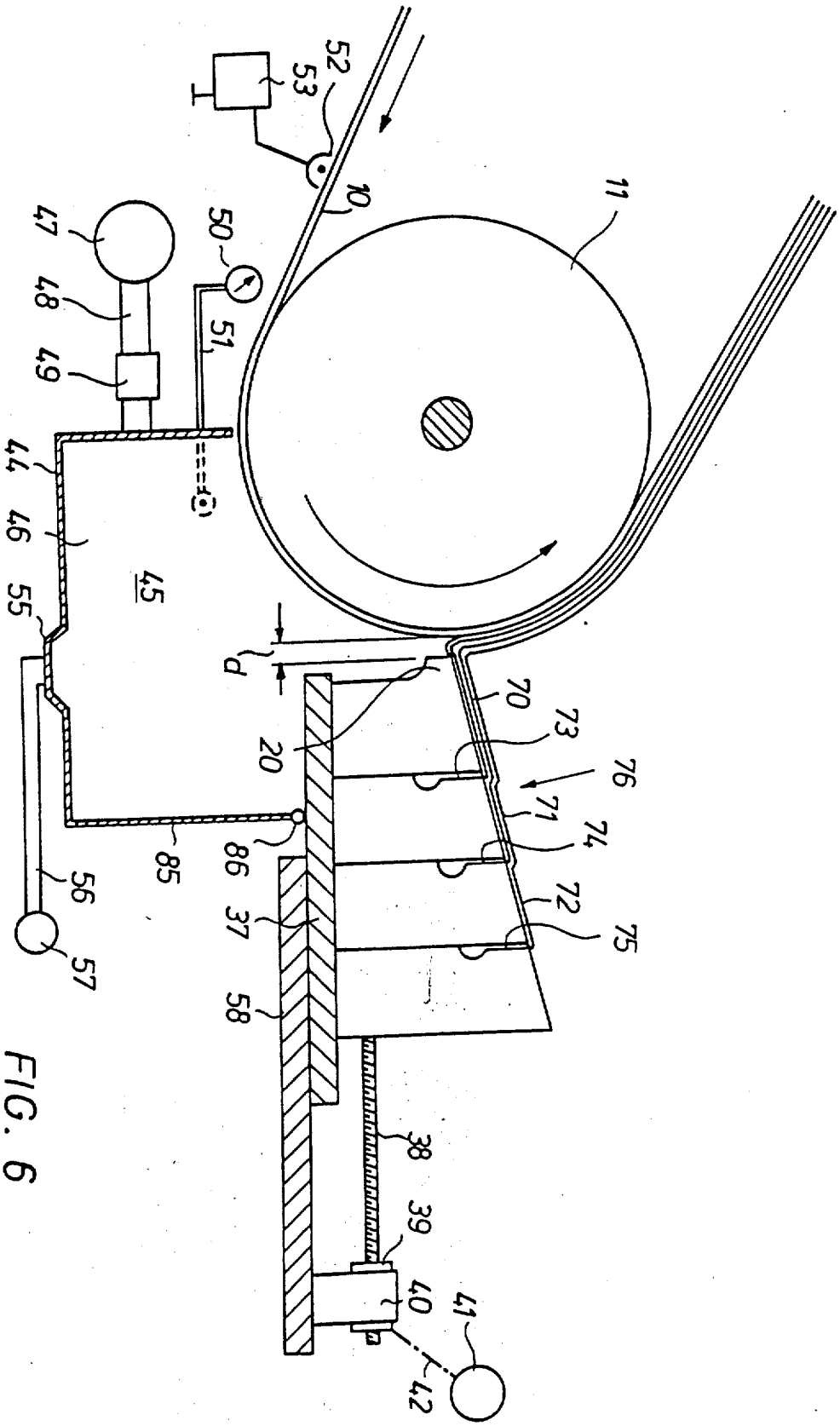
Figure 7:
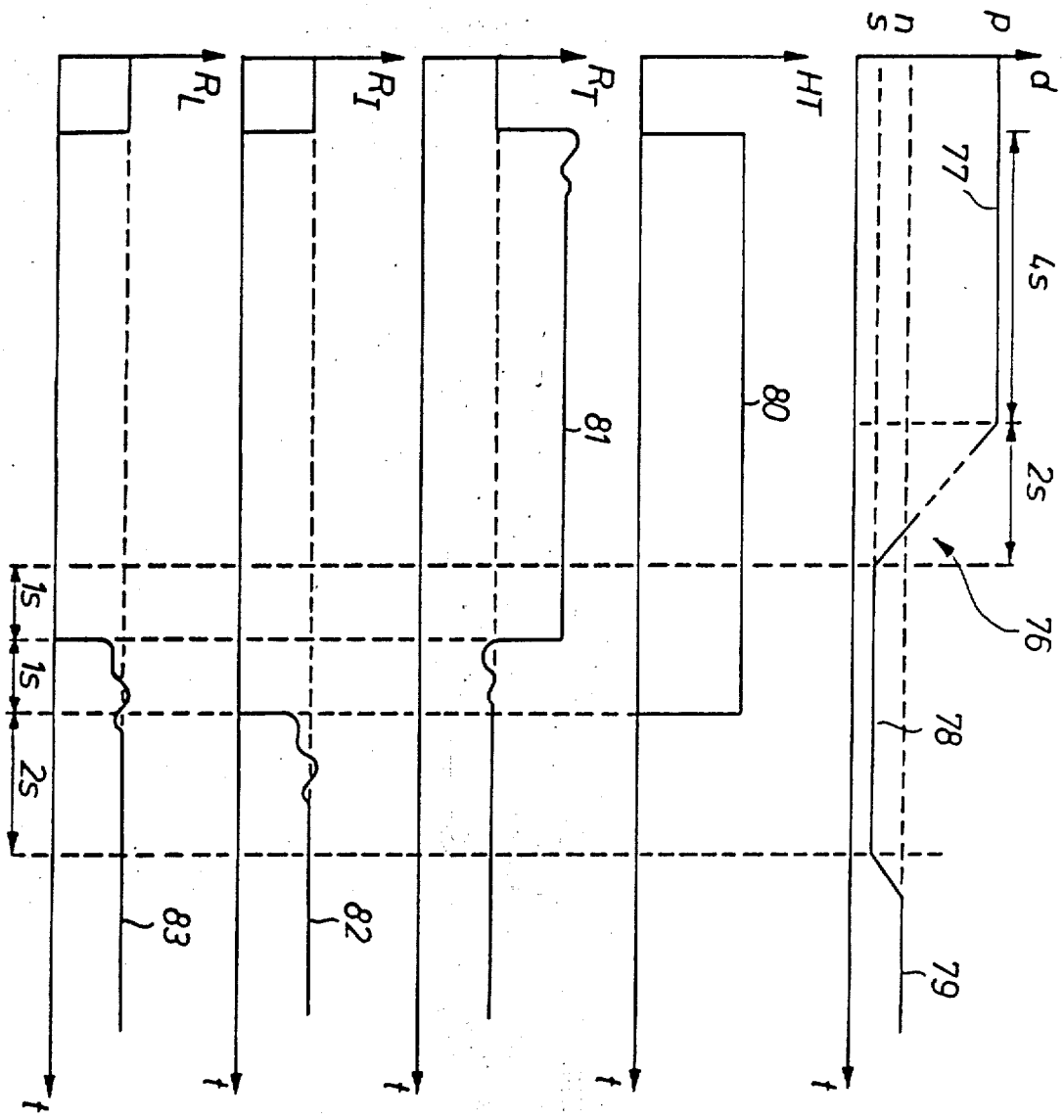

The invention will be described hereinafter by way of example with reference to the accompanying drawings wherein:

FIG. 1 is a diagrammatic illustration of one embodiment of a two-layer slide-hopper coater, FIG. 2 is a diagram illustrating different adjustments of the flow rates of the coating compositions during the starting of the coater of FIG. 1, FIG. 3 illustrates different adjustments of the coater of FIG. 1 during the starting procedure, FIG. 4 illustrates one form of wetting contact of the upper layer with the web, whereas FIG. 5 illustrates another form of wetting contact of the upper layer with the web, FIG. 6 is a diagrammatic illustration of one embodiment of a three-layer slide-hopper coater, and FIG. 7 is a diagram illustrating the different sequences of the starting procedure of the coater of FIG. 6.

Referring to FIG. 1 which illustrates in a diagrammatic way a slide hopper coating station 12 for the coating of two layers as a composite layer onto a moving web, a film or paper web 10 is drawn from a supply roll, not shown and partially wrapped around a free-rotating backing roller 11 for movement past a coater 13. As the web 10 is moved into the coating station, the liquid compositions are applied to the outer surface of the web which then is conveyed through a chilling and a drying station to a wind-up station, not illustrated.

The coater 13 of the station can be of the type disclosed in U.S. Pat. Nos. 2,761,419 and 2,681,294 in which a coating composition 14 is continuously fed towards a distributing manifold 15 at a given rate and the composition is forced through a layer distributing slot 16 in the form of a ribbon and out onto a downwardly inclined slide surface 17. The ribbon flows by gravity in the form of a layer 18 to a point where it forms a coating bead or pile 19 between the lip 20 of the coater and the outermost surface of the moving web 10. A second coating composition 21 is fed towards a distributing manifold 22 at a given rate, and is forced through a distributing slot 23 in the form of a ribbon and out onto the downwardly inclined slide surface 24 where it flows as a layer 25. As the layer 25 reaches the layer 18 it flows on top thereof and the two layers 18 and 25 flow as a composite layer down the slide surface 17 and into the coating bead 19.

The feeding of the coating compositions to the coating device may occur in different ways. In the present embodiment, the feeding of the first composition is illustrated as occurring from a pressurized supply vessel 26 through a flow-rate meter 27, a valve 28 and a filter 29. The valve is controlled by a controller 30 which compares the output signal of flow rate meter 27 with a pre-set flow rate signal at input 8, in order to produce an output signal for the adjustment of the valve 28 in such a way that the desired flow rate is obtained. The wet thickness of the coated layer is the quotient of the rate of flow divided by the speed of the web and the width of the layer.

The feeding of the second liquid composition may occur in a similar way from a pressurized vessel 35 through a flow rate meter 31, a valve 32 and a filter 33. A controller 36 controls the valve 32 in response to the information from the member 31 and a set value at 9.

It will be understood that the described coating station will comprise in practice more expedients than those described hereinbefore. Expedients known in the art are: temperature and pressure sensors, related control circuits, means for thermostatically controlling the different liquid circuits, rinsing supplies for rinsing the liquid circuits of the coating station, means for the deaeration of the coating composition, and the coating circuits, etc.

The coater 13 extends parallelly with respect to the backing roller 11 and is mounted on a sturdy base plate 37. The base plate 37 is horizontally displaceable on a stationary support 58 and is guided by means, not illustrated. By means of a pair of laterally spaced lead screws, only one screw 38 being shown, the coater can be moved towards and away from the surface of the web 10 to control the size of the coating bead, and also to permit threading up of the coating station and to start the coating procedure in accordance with the invention. Each lead screw is at one end fixedly attached to the movable coater 13, and near the other end threadedly engaged by a nut 39 that is rotatable in a bearing block 40, and that may be rotated by motor means 41 coupled mechanically to the nut as shown by the dash- and dot-line 42.

The normal coating position of the coater is represented in draw lines. A common distance range of the gap d is from 0.2 to 0.4 mm.

The remote position of the coater, in view of the starting procedure of the coating, is illustrated in broken lines 84. Suitable distances between the lip 20 and the web may range for that position between 10 and 100 mm.

A casting 44 having lateral end walls 45 (only one being shown), forms together with the coater 13 and a portion of the roller 11 a chamber 46. A vacuum pump 47 is connected to the chamber 46 by a pipe 48 which may have a regulating valve 49. The pressure within the chamber can be measured by means of a pressure gauge 50 which is connected to the chamber by means of a line 51.

The rear wall 85 of the chamber 45 ends in a flexible joint 86 which ensures an airtight seal between the chamber wall and the base plate 37, and yet permits horizontal displacements of the base plate 37.

Finally the coating station is provided with an electrostatic charging station 52 that is connected to a high voltage source 53 for the application of an electrostatic charge to the surface of the web to be coated, and with an electrically grounded electrode 54 at the rearside of the web. The electrode 54 may have the form of a roller.

EXAMPLE 1

The method of starting a new coating by means of the described installation is now described by way of example with reference to a two-layer photographic anti-halation coating for photographic film for graphic purposes. The coating that issues through the discharge slot 16 is a anti-halation aqueous solution containing gelatin and dyes with a solid content of 56 $g.l^{-1}$ and a viscosity of 16 mPa.s. The viscosity of the present layer, and also of all the other layers which will be described hereinafter, has been measured at a temperature of 36° C. The rate of flow through the slot 16 in normal operation is such that a wet layer thickness on the web of 40 micrometer is obtained. The coating that issues through the discharge slot 23 is an anti-stress aqueous gelatin solution without dyes with a solid contents of 45 $g.l^{-1}$ and a viscosity of 4 mPa.s. The normal rate of flow through the slot 23 is such that a wet layer thickness of 20 micrometer is obtained.

For the pre-starting of a new coating, the coater 13 is withdrawn from the web so that a lip distance of d=100 mm is obtained, and the liquid supplies to the two coating sections are adjusted so that both layers are produced nearly at their nominal rates. The composite coating layer flows vertically down from the lip 20, and is collected in a sink 55 from which the coating liquid is discharged through a pipe 56 into a reservoir 57. At suitable times the liquid of the reservoir 57 may be pumped to an installation for the recovery of the valuable ingredients.

The vacuum pump 47 is started, and the valve 49 is adjusted in such a way that in normal operation of the coater a pressure difference delta p over the coating bead of 150 Pascal will be obtained. This adjustment is based on experience acquired during normal coating.

The situation described so far corresponds with phase A of the diagram of FIG. 2 wherein the abcissa is a time axis, and the ordinate represents the rate of flow of the light-sensitive, lower layer, represented by the curve 60, and the rate of flow of the anti-stress, upper layer, represented by the curve 61.

The diagram of FIG. 3 represents the position (d) of the coater with respect to the web, see the curve 62, the pressure difference (delta p) over the coating bead (as calculated from the atmospheric pressure minus the pressure in the chamber 46) see the curve 63, and the electrostatic charging (HT) of the web, see the curve 64. In the present example, the electrostatic charging occurred by means of a charging wire at a distance of 2 mm from the web, and connected to a D.C. voltage of 10 kV. The time axes and the time phases of the diagrams of FIGS. 2 and 3 correspond with each other.

It should be noted that the left-hand portion of the curve 62 is not drawn on a true scale in view of the large differences between the values of d, and therefore this section of the curve has been illustrated in broken lines.

The preparations as just described being finished, the actual starting procedure is started at phase A. The operator controls the feed circuits of the coating compositions so that the rate of flow of the lower layer rapidly decreases to zero, see the curve 60, whereas the rate of flow of the upper layer is increased by approximately 50%, see the curve 61.

The reduction to zero of the rate of flow of the lower layer 18 has for effect that the distribution slot 16 remains filled with coating composition up to the top, the coating composition remaining on the slide surface 17 being carried away by the composition discharged from the slot 23. Subsequent re-establishment of the flow rate through the orifice 16 will occur without the formation or inclusion of air bubbles in the produced ribbon of coating composition.

At phase B, the operator controls the motor means 41 to reduce the initial gap d of 100 mm to a start gap, in the present case d=0.2 mm. This start position of the coater is obtained at phase C and is illustrated by the section 68 of the curve 62.

The reduction of the gap between the lip of the coater and the web from a preparatory value to a start value automatically causes the establishment of a vacuum in the chamber 46, whereby a pressure difference over the gap delta p=150 Pascal is obtained.

The start coating pattern of the liquid on the web will each time be different, but a common pattern is illustrated in FIG. 4, where the abcissa w represents the width of the web and the ordinate L represents the length of the web. Under the influence of the electrostatic charge on the web, there are formed a plurality of laterally spaced bridges of coating liquid between the web and the liquid flowing from the lip of the coater, that result in the coating on the web of a plurality of corresponding streaks 65 separated by completely uncoated zones 66. The openings between the bridges of coating liquid are caused by currents of air that tend to traverse the bead upon its establishment, said currents of air resulting from the underpressure in the casting behind the bead. The initial width of the streaks 65 was comprised between 2 and 4 mm in the present example, whereas the width of the zones 66 varied between 15 and 30 mm.

The streaklike pattern of coating liquid on the web establishes very rapidly at some moment situated between phases B and C.

If the coating would go on without further interventions, the illustrated coating pattern would undergo but few variations.

At phase D, the operator controls the liquid feed circuits so that the normal rates of flow are re-adjusted. The normal rates are obtained at phase E. Visual inspection of the web during the coating teaches that during the period from phase D to phase E, the re-establishing lower, high-viscous layer 18 operates to close the openings in the coating bead of the upper, low-viscous layer 25, so that the coating bead very rapidly takes the form of a uniform, wrinkle-free meniscus composed of two coating liquids. The noticing of the desired effects is greatly facilitated by the fact that the upper layer 25 is an antistress layer, and thus optically translucent, whereas the lower layer 18 is an antihalation layer, the opacity of which is well visible through the upper layer.

The image of the dried web covering phase D to E shows a plurality of translucent streaks, see the streaks 65 of FIG. 4, described already, that gradually increase in width as well as in optical density as a consequence of the lower layer that is added thereto. These streaks (that in fact became bands) are separated by narrow streaks of uncoated zones that, on their turn, disappear so that finally a uniform coating pattern is obtained.

The coating pattern from phase D to E described hereinbefore, covers a web length of less than ten meters.

The margins of the web may, as usual in the art, be kept uncoated in order to limit waste of coating material as the margins are trimmed from the web in a later production phase.

As a uniform coating has been obtained, the coating gap is slightly increased, in the present example d is adjusted to 0.3 mm, in order for the coating to become less dependent for longitudinal thickness variations on thickness fluctuations of the web, on unroundness of the backing roller 11, on the passage of web splice through the coating gap, etc. The described adjustment of d occurs from phase E to F in the diagram, and the section 69 of the curve represents the normal coating gap $d_a$=0.3 mm.

At phase F the start procedure of the coating has come to an end, and the normal coating can go on without further interventions.

It will be understood that all manual operations that have been described hereinbefore, will be performed automatically in practice by computer control.

In the present example, the time period between phases A and F amounted to 10.5 s. This period can be shorter, depending on the coating speed, the layer thicknesses, the particular rheological properties of the coating compositions, the wetting properties of the web and more in particular of a subbing layer or a previously coated and dried silver halide layer thereon, the operational speed of the valves in the different feed circuits of the coating compositions, etc.

It has been shown that for certain coating compositions the first wetting contact with the web does not occur as illustrated in the drawing of FIG. 4, but rather as shown in FIG. 5. Thus, the first contact of a coating liquid with the web under the influence of the electrostatic charge on the web occurs at one or a plurality of longitudinal zones of the web, as shown by way of example for one web zone 67 in the figure, but this zone increases spontaneously in width so that after a web length ranging from a few to some tens of meters, there becomes established a uniform, defect-free coating bead between the coater and the web, without any further intervention.

The re-establishing of the high-viscous layer may in such case still be helpful for the closing of openings in the coating bead, but it may also occur that the spontaneous closing of the starting bead of the low viscous layer proceeds so rapidly that in fact the high-viscous layer takes no part in such closing.

The time axis of the diagrams of FIGS. 2 and 3 looked as follows for the described example:

A: 0 s
B: 4 s
C: 5 s
D: 6 s
E: 10 s

F: 10.5 s

The starting operation of the coating may be simplified if the reduced coating gap of the coater is not used, but instead the coater is directly put at phase C into its normal coating position, i.e., the one illustrated by line section 69 in the diagram of FIG. 3. The successful operation of such simplified adjustment depends on the wetting characteristics of the coating liquids. If these are not so well suited for starting the coating, then either the temporarily reduction of the gap d, or the use of a stronger electrostatic charging, or the application of both measures simultaneously may be required in order to obtain a satisfactory start.

EXAMPLE 2

This second example relates to the starting of a three-layer coating for performing the method as disclosed in U.S. Pat. No. 4,001,024 mentioned hereinbefore.

Referring to FIG. 6, a slide hopper coater 76 is used of a type as illustrated in FIG. 1, with the difference that now three coating slots are provided in the slide surface. Three different liquid circuits are provided for feeding the respective coating channels, and these circuits may be individually controllable in a way similar to the circuits of the FIG. 1 arrangement. The coating compositions issue from the slots in the form of layers 70, 71 and 72 which are applied as a composite layer onto the web 10.

In the present example, the lower layer 70 is an aqueous silver halide dispersion used in the manufacturing of photographic X-ray film. The solid contents of the composition is 124 $g.l^{-1}$ and the viscosity amounts to 13 mPa.s. The rate of flow through the slot 73 is such that a wet layer thickness of 5 micrometer is obtained.

The intermediate layer 71 has the same composition as the layer 70, but the solid contents is 264 $g.l^{-1}$ and the viscosity amounts to 40 mPa.s. The rate of flow through the slot 74 is such that a wet layer thickness of 28 micrometer is obtained.

The upper layer 72 is an antistress aqueous gelatin solution with a solid contents of 57 $g.l^{-1}$ and a viscosity of 5.5 mPa.s. The rate of flow through the slot 75 is such that a wet layer thickness of 25 micrometer is obtained.

The different manipulations for the starting of the coating are described hereinafter with reference to FIGS. *7a* to *7e* wherein the different diagrams stand for the following.

The curve 76 of FIG. *7a* illustrates the different positions of the coater. The curve section 77 points to the preparatory position of the coater, the section 78 indicates the start position, and the section 79 is the normal coating position. The curve section 77 is not drawn on a true scale, in view of the magnitude of the value of d. The coating gaps corresponding with the different positions are respectively: $d_p=100$ mm, $d_s=0.2$, and $d_n=0.3$ mm. The curve 80 of FIG. *7b* illustrates the electrostatic charging of the web by means of a D.C. potential of 10 kV. The curve 81 of FIG. *7c* illustrates the rate of flow $R_T$ of the upper layer 72. The oscillations at the beginning and after the end of the temporarily increased rate are transient phenomena that are unimportant in the operation of the method. The increased rate of flow amounts to 200% of the normal flow rate. The curve 82 of FIG. *7d* illustrates the rate of flow $R_I$ of the intermediate layer 71. The curve 83 of FIG. *7e* illustrates the rate of flow $R_L$ of the lower layer 70. In normal operation of the coating, a pressure difference delta p=150 Pascal exists over the coating bead. Preferably the operation of the starting of the coating proceeds entirely automatically. The time axis indications reveal a complete start period of 10 seconds.

EXAMPLE 3

This example relates to a two-layer coating used in the production of a photographic film for graphic purposes.

Referring to the coater illustrated in FIG. 1, the coating that issues through the distribution slot 16 is an aqueous silver halide dispersion with a solid contents of 171 $g.l^{-1}$ and a viscosity of 28 mPa.s. The rate of flow is such that a wet layer thickness of 50 micrometer is obtained. The layer that issues through the slot 23 is an antistress layer with a solid contents of 50 $g.l^{-1}$ and a viscosity of 7 mPa.s. The wet thickness of the layer amounts to 20 micrometer.

For the preparation of the start of a new coating, the coater 13 is withdrawn from the web so that a web distance d of approximately 100 mm is obtained, and the liquid supplies to the two coating slots are adjusted so that both layers are produced approximately at their normal rates. The compositions flow down as described hereinbefore in example 1, and the valve 49 of the vacuum pump is adjusted so that in normal operation a pressure difference delta p of 150 Pascal will be obtained over the coating bead.

The starting procedure proceeds generally as illustrated in FIGS. 2 and 3, except that now the rate of flow of the lower layer is temporarily reduced to 0 whereas the rate of flow of the upper layer is increased to increase the layer thickness from 20 to 40 micrometer. The normal coating gap of 0.3 mm was reduced to 0.2 mm during the starting. The complete starting period amounted to 10 s.

EXAMPLE 4

This example relates to a two-layer coating in the production of a film for image-intensifier photography.

Referring to the coater illustrated in FIG. 1, the coating that issues through the distribution slot 16 is an aqueous silver halide dispersion with a solid contents of 215 $g.l^{-1}$ and a viscosity of 18 mPa.s. The rate of flow is such that a wet layer thickness of 59 micrometer is obtained. The layer of slot 23 is an anti-stress layer with a solid contents of 40 $g.l^{-1}$ and a viscosity of 4 mPa.s. The wet thickness of the layer amounts to 29 micrometer.

The starting of the coater proceeds as generally described in example 1, with the difference that the rate of flow of the silver halide layer is reduced to 0, whereas the rate of flow of the antistress layer is increased to obtain a wet layer thickness of 52 micrometer. The normal coating gap was temporarily reduced from 0.3 to 0.2 mm. The starting period amounted to 10.5 s.

EXAMPLE 5

This example relates to a three-layer coating for the production of a photographic film for graphic purposes. Referring to the coater 76 as shown in FIG. 6, the lower layer 70 is an aqueous gelatin solution containing a developing agent, with a solid contents of 148 $g.l^{-1}$ and a viscosity of 23 mPa.s. The rate of flow through the slot 73 is such that a wet layer thickness of 40 micrometer is obtained.

The intermediate layer 71 is an aqueous silver halide dispersion with a solid contents of 214 $g.l^{-1}$ and a viscosity of 27 mPa.s. The rate of flow through the slot 74 is such that a wet layer thickness of 37 micrometer is obtained.

The upper layer 72 is an antistress aqueous gelatin solution with a solid contents of 45 $g.l^{-1}$ and a viscosity of 4 mPa.s. The rate of flow through the slot 75 is such that a wet layer thickness of 20 micrometer is obtained.

For the starting of the coating, the coater 76 is withdrawn from the web so that a distance d of about 100 mm is obtained, and the liquid supplies to the coating slots are adjusted so that the three layers are produced at their normal rates. The compositions flow down as described hereinbefore with reference to example 2, and the vacuum installation is adjusted so that in normal operation of the coater a pressure difference delta p of 150 Pascal will be obtained over the coating bead. The starting procedure proceeds generally as illustrated in FIG. 7, except that now the rates of flow of the layers are changed so that the wet thickness of the lower layer is 0 micrometer, the wet thickness of the intermediate layer is also 0, and the wet thickness of the upper layer is 36 micrometer.

The invention is not limited to the described embodiments and examples. The start procedure may be used for the coating of more than three layers simultaneously.

The adjustment of the gap d may also occur by displacement of the backing roller, rather than by displacement of the coater itself. The driving of the displaceable members may also be performed by hydraulic or air motors, step motors, etc.

The rate of flow of the different layers through their corresponding distribution slots, prior to the initiation of the start procedure, must not necessarily be the rates of flow in normal operation of the coater but may be smaller or larger, depending on the temporary increase or decrease of the rates of flow through the respective discharge slots during the starting procedure.

We claim:

1. A method of coating a moving web with a composite liquid layer consisting of at least two distinct superimposed liquid layers with different viscosities including at least one relatively high viscosity layer and at least one relatively low viscosity layer, by moving the web adjacent and relative to a coating device, producing in the coating device distinct liquid layers and superimposing said liquid layers onto each other to form one composite layer having a low viscosity layer on the side opposite the web, discharging the composite layer from the coating device onto said web to form and maintain a bead of liquid composition between a lip of the coating device and the moving web, and subjecting the bead of liquid coating composition to a differential air pressure to withhold the bead from movement in the direction of travel of the web, the air pressures being selected to retain the bead of coating composition in a coating position between the coating device and the web and to maintain a uniform coating on the web, the higher air pressure being on the side of the bead remote of the web, in which method the coating is pre-started by establishing a distance between the coater and the web which is greater than the normal coating gap and forming a flowing stream of said distinct liquid layers, characterised in that the coating is started by, reducing to zero the rate of flow of at least that high viscosity layer proximate said web, reducing the distance between the coater and the web to at most the normal coating gap and initiating the wetting of the web by one such lower viscosity layer distant from said web, and then adjusting the rates of flow of the liquid layers to their normal coating values.

2. A method according to claim 1, wherein there is more than one high viscosity layer, and wherein the rate of flow of all of such high viscosity layers is reduced to zero.

3. A method according to claim 1, comprising adjusting the rate of flow of said viscosity layers such that during the starting a thickness of at least 20 micrometer is obtained therefor.

4. A method according to claim 1, wherein the viscosities of said low and high viscosity layers differ from each other according to a ratio of at least 1:1.50.

5. A method according to claim 1, wherein the viscosity of the high viscosity layer is higher than 10 mPa.S.

6. A method according to claim 1, comprising initiating the wetting of the web by the low viscosity layer, by electrostatically charging the web during the starting procedure.

7. A method according to claim 1, wherein the normal rate of flow of the low viscosity layer is increased for the starting of the coating.

8. A method according to claim 3 wherein said composite layer includes at least two low viscosity layers and during starting the combined wet-layer thickness of said layers is at least 20 micrometer.

9. A method according to claim 1, comprising reducing the distance between the coater and the web during the starting of the coating to a distance that is smaller than the normal coating gap, and re-adjusting said distance to the normal coating gap after the rates of flow of the distinct liquid layers have been adjusted to their normal values.

10. A method according to claim 1, wherein the composite layer is a photographic layer consisting of at least two distinct layers, the layer opposite the web being a low viscosity anti-stress layer and a layer adjacent said web being a high viscosity light-sensitive layer.

11. A method according to claim 1, wherein the composite layer consists of at least three layers wherein the intermediate layer is a high viscosity layer, and the low viscosity layer proximate said web is of the same composition in more dilute form as said intermediate layer.

* * * * *

UNITED STATES PATENT AND TRADEMARK OFFICE

CERTIFICATE OF CORRECTION

PATENT NO. : 4,877,639

DATED : October 31, 1989

INVENTOR(S) : Willemsens, et al.

It is certified that error appears in the above-identified patent and that said Letters Patent is hereby corrected as shown below:

In the Drawings:

Cancel the drawings in entirety and substitute the accompanying correct drawings.

The title page should be deleted to appear as per attached title page.

Signed and Sealed this

Twenty-seventh Day of November, 1990

*Attest:*

HARRY F. MANBECK, JR.

*Attesting Officer*

*Commissioner of Patents and Trademarks*

United States Patent [19]

Willemsens et al.

[11] Patent Number: 4,877,639

[45] Date of Patent: Oct. 31, 1989

[54] COATING METHOD

[75] Inventors: Karel S. Willemsens, Berchem; Willy N. V. Abbeneyen, Merksem; Frans B. Criel, 's-Gravenwezel, all of Belgium

[73] Assignee: Agfa-Gevaert N.V., Mortsel, Belgium

[21] Appl. No.: 213,112

[22] Filed: Jun. 29, 1988

[30] Foreign Application Priority Data

Jul. 21, 1987 [EP] European Pat. Off. ..... 87201378.4

[51] Int. Cl.[4] ..... B05D 1/26; B05D 1/30; B05D 1/34

[52] U.S. Cl. ..... 427/13; 427/412.2; 427/420; 118/411

[58] Field of Search ..... 427/13, 412.2, 420; 118/411

[56] References Cited

U.S. PATENT DOCUMENTS 3,220,877 11/1965 Johnson ..... 427/420
3,531,314 9/1970 Kerr et al. ..... 427/27
4,525,392 6/1985 Ishizaki et al. ..... 427/420

*Primary Examiner*—Shrive Beck
*Attorney, Agent, or Firm*—William J. Daniel

[57] ABSTRACT

A method of starting the bead coating of a moving web with a composite liquid layer comprising a higher viscous and lower viscous layer of coating compositon, by reducing the rate of flow of the higher viscous layer to zero, reducing the pre-starting distance between the coater and the web to at most the normal coating gap and initiating the wetting of the web by the lower viscous layer, and then adjusting the rate of flow of the higher viscous layer to the normal coating value.

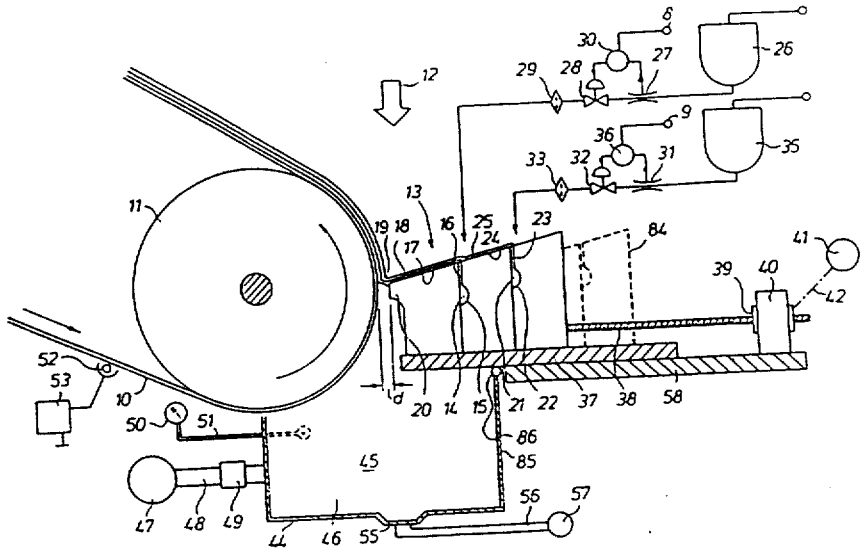

11 Claims, 5 Drawing Sheets